US006994587B2

(12) United States Patent
Buenz et al.

(10) Patent No.: US 6,994,587 B2
(45) Date of Patent: Feb. 7, 2006

(54) COAXIAL CABLE CONNECTOR INSTALLABLE WITH COMMON TOOLS

(75) Inventors: Larry Buenz, Tinley Park, IL (US); John Dykstra, Tinley Park, IL (US)

(73) Assignee: Andrew Corporation, Orland Park, IL (US)

( * ) Notice: Subject to any disclaimer, the term of this patent is extended or adjusted under 35 U.S.C. 154(b) by 51 days.

(21) Appl. No.: 10/604,470

(22) Filed: Jul. 23, 2003

(65) Prior Publication Data

US 2005/0017828 A1 Jan. 27, 2005

(51) Int. Cl.
*H01R 9/05* (2006.01)

(52) U.S. Cl. ..... 439/578

(58) Field of Classification Search ..... 439/578, 439/583, 584, 585

See application file for complete search history.

(56) References Cited

U.S. PATENT DOCUMENTS

| | | | | |
|---|---|---|---|---|
| 4,422,715 | A | | 12/1983 | Williams et al. |
| 4,575,274 | A | | 3/1986 | Hayward |
| 4,701,001 | A | | 10/1987 | Verhoeven |
| 4,706,384 | A | | 11/1987 | Schreiber et al. |
| 4,927,378 | A | | 5/1990 | Song |
| 5,302,067 | A | * | 4/1994 | Rath ..... 411/281 |
| 5,314,349 | A | | 5/1994 | Czeschka et al. |
| 5,354,217 | A | | 10/1994 | Gabel et al. |
| 5,595,502 | A | * | 1/1997 | Allison ..... 439/583 |
| 5,651,698 | A | * | 7/1997 | Locati et al. ..... 439/578 |
| 5,660,565 | A | | 8/1997 | Williams |
| 6,080,015 | A | | 6/2000 | Andreescu |
| 6,415,499 | B1 | | 7/2002 | Holland et al. |
| 2002/0031943 | A1 | | 3/2002 | Kanda et al. |

* cited by examiner

*Primary Examiner*—Tho D. Ta
(74) *Attorney, Agent, or Firm*—Babcock IP, LLC

(57) ABSTRACT

A coaxial connector may be configured with multiple interleaved concentric threads that reduce connector assembly threading requirements. A cable sheath stripping feature may be incorporated into the connector, eliminating the need for a separate sheath stripping tool. Also, a pair of internal rings may be added which co-operate to couple the connector body with a rotatable inner coupling sleeve until a predetermined level of torque is applied whereupon complementary protrusions formed on the rings deform and slip past each other, protecting the connector from damage due to application of excessive torque and eliminating the need for torque wrenches during connector installation.

24 Claims, 7 Drawing Sheets

COAXIAL CABLE CONNECTOR INSTALLABLE WITH COMMON TOOLS

BACKGROUND OF INVENTION

1. Field of the Invention

The present invention generally relates to coaxial cable connectors. More specifically, the present invention relates to a coaxial cable connector with ease of installation features that is installable with reduced connector specific tooling requirements.

2. Description of the Prior Art

Coaxial cable connectors are used, for example, in communication systems requiring a high level of reliability and precision. A connector that is poorly installed may damage equipment, significantly degrade system performance and or lead to premature system failure. Therefore, prior connectors typically include extensive installation instructions that require costly specialized tools specific to each connector.

One specialized tool for connectors is the jacket stripper. The jacket stripper is used to accurately strip away outer sheathing from the coaxial cable to expose a specified length of outer conductor for electrical contact with the desired surfaces of the connector. If the amount of outer sheathing removed is short, long or non-uniform, the electrical connection and or the environmental seal of the connector to the cable may be degraded.

Connectors may be used in confined spaces, for example among banks of cables with minimal spacing between them. Confined spaces increase the difficulty of proper connector installation and or interconnection by increasing the time required to make repeated small turns allowed by the confined space when threading the connectors by hand and or with the aid of a wrench. Also, connectors may be installed in exposed locations such as the top of radio towers where installation personnel may be less inclined to properly follow time-consuming installation procedures.

Threaded connections on and between connectors are typically tightened using wrenches having the potential for large moment arm force generation that may damage the connector and or associated cable(s). Therefore, use of a torque wrench with a torque setting specific to each connector is often specified by the prior connector installation instructions. Applying the proper torque, for example 15–20 lb-inches, to threaded connections ensures correct electrical interconnection and prevents application of excessive force that may deform or otherwise damage threads, seals and or the relatively soft metal(s) of the cable(s). The torque wrench is a costly and easily damaged tool that the installation personnel may not always have on hand or bother to use correctly, if at all.

Competition in the coaxial cable connector market has focused attention on minimization of overall costs, including training requirements for installation personnel, reduction of dedicated installation tooling and the total number of required installation steps and or operations.

Therefore, it is an object of the invention to provide a connector that overcomes deficiencies in the prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
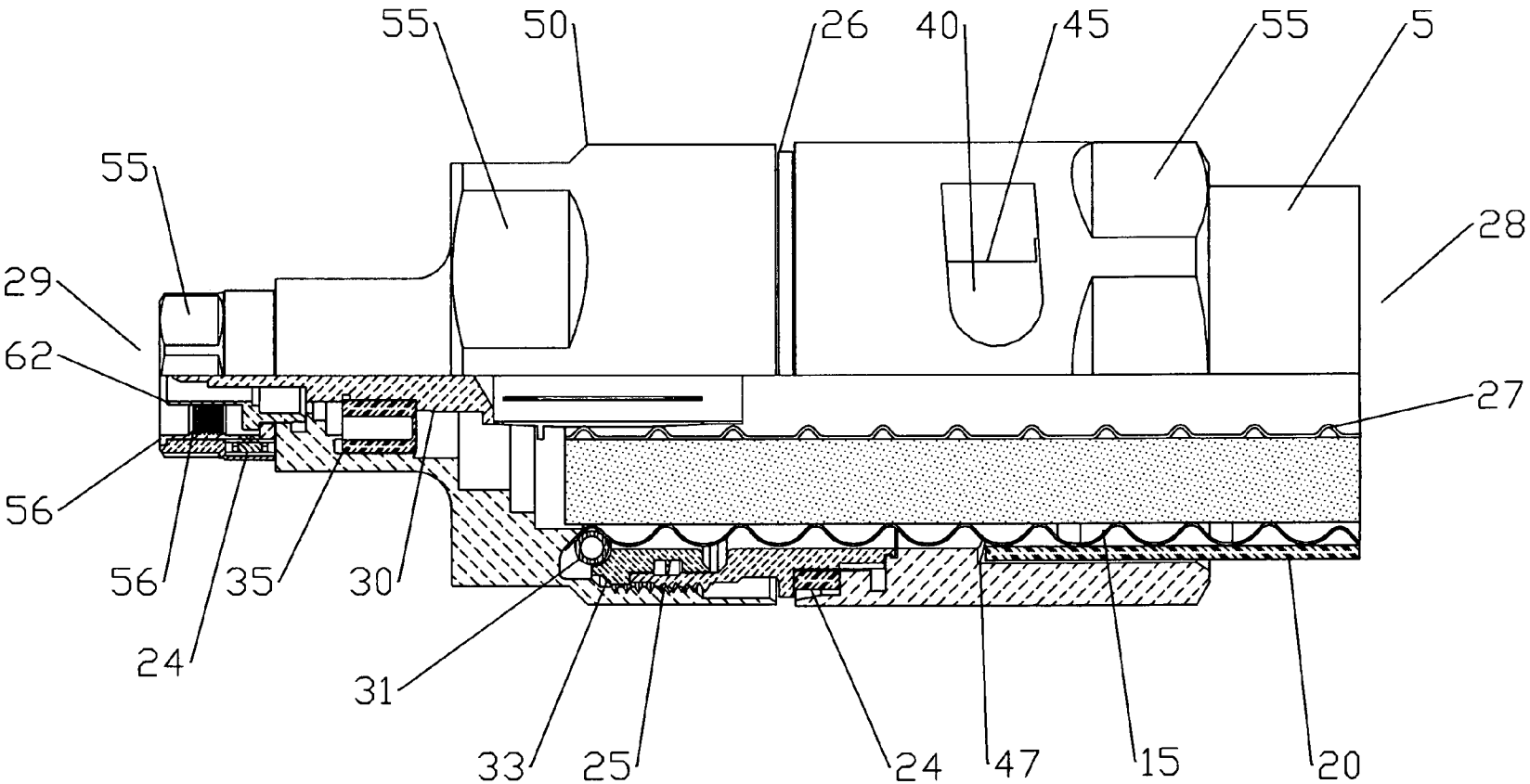
FIG. 1 is a partial cut-away side view of a coaxial connector according to one embodiment of the invention and a coaxial cable for receiving the connector.

As shown in FIG. 1, a connector 1 for use with a coaxial cable 5 has a rear clamp nut 10 adapted to fit over an end portion of the cable 5. A sheath 20 of the cable 5 is removed from the end of the cable 5 to expose the outer conductor 15. Threads 25 operate to clamp the outer conductor 15 between the connector body 50, a circular coil spring 31, a thrust collar 33 and an inner collar 26 coupled to the rear clamp nut 10 via an over tightening protection assembly 24, described herein below, to secure the connector 1 to the cable 5. If the over tightening protection assembly 24 feature is not used, the threads 25 may be formed on the clamp nut 10 and the inner collar 26 omitted. Also, the circular coil spring 31 may be omitted and the outer conductor 15 clamped directly between the connector body 50 and the inner collar 26 or the rear clamp nut 10. An inner conductor 27 of the coaxial cable 5 engages an inner contact 30 of the connector 1 that is spaced away from the outer conductor 15 mating surfaces by an insulator 35.

Figure 2:
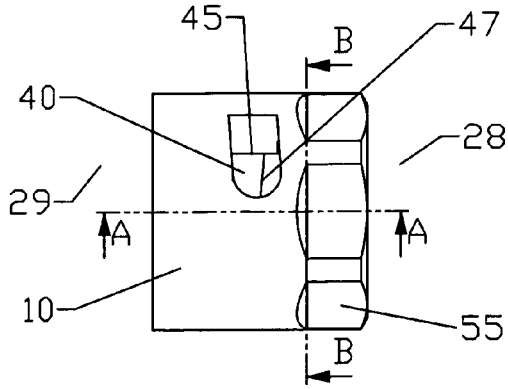
FIG. 2 is an external side view of a rear clamp nut according to one embodiment of the invention.
Figure 3:
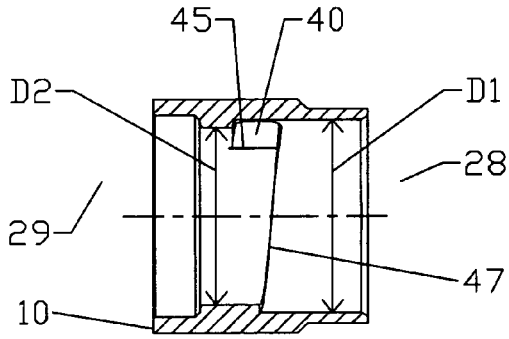
FIG. 3 is a side section view, along line A—A, of FIG. 2.
Figure 4:
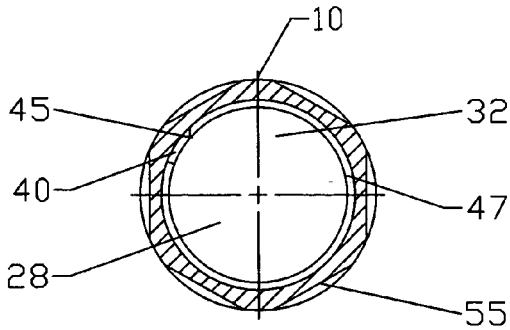
FIG. 4 is an end section view, along line B—B, of FIG. 2.

A cable stripping feature of the connector 1 is demonstrated by FIGS. 2–4 which show a simplified version of the rear clamp nut 10. The rear clamp nut 10 has a rear clamp nut bore 32 with a first inner diameter D1 at the cable end 28 of the connector 1 adapted to receive the coaxial cable 5 with sheath 20. A smaller second inner diameter D2 of the rear clamp nut bore 32 at a connection end 29 is adapted to receive only the outer conductor 15 of the cable 1.

A slot 40 formed in the rear clamp nut 10 has a cutting edge 45 at the end of a helical step 47 between the first inner diameter and the second inner diameter. When the rear clamp nut 10 is placed over the end of the cable 5, the sheath 20 bottoms against the helical step and the cutting edge 45. Rotating the rear clamp nut 10 about the cable 5 drives the sheath 20 against the cutting edge 45 which cuts and separates the sheath 20 from the outer conductor 15. The cut portion of the sheath 20 exits through the slot 40 as the rear clamp nut 10 is advanced over the cable 5. The sheath 20 is trimmed to the correct length, for example, when the outer conductor 15 reaches the connection end of the rear clamp nut 10.

Figure 5:
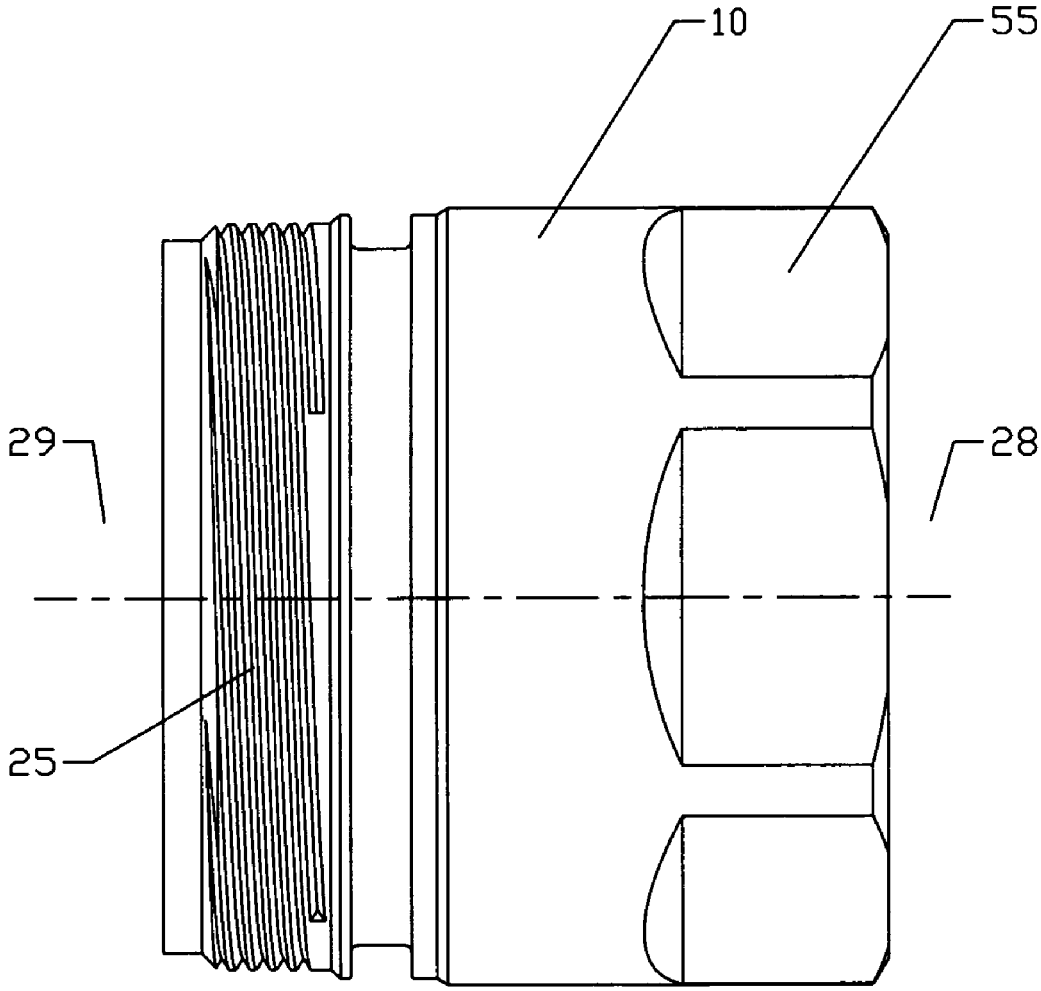
FIG. 5 is an external side view of a rear clamp nut according to another embodiment of the present invention.

The rear clamp nut 10 may be attached to the connector body 50 via threads 25 shown in detail on FIG. 5. The threads 25 comprise four interleaved concentric threads equally spaced from each other along the length of the connector. Each of the four threads has the same lead with thread ends spaced 90 degrees apart from each other around the axis of the connector 1. The interleaved threads 25 have a pitch that is four times normal, resulting in threaded assembly of the connector 1 requiring only one quarter the number of turns compared to a common single thread. Because the threads 25 are interleaved, the threads maintain the same overall thread to thread contact area resulting in a thread 25 with strength comparable to common single threading but with a pitch that is increased by a factor of 4. In alternative embodiments, use of two or three interleaved concentric threads will result in a one half or one third reduction, respectively, in the number of turns required to attach the rear clamp nut 10 to the connector body 50. Flats 55 formed in the outer surface of the rear clamp nut 10 and connector body 50 provide tool surfaces for the tightening of rear clamp nut 10 against the connector body 50.

Figure 6:
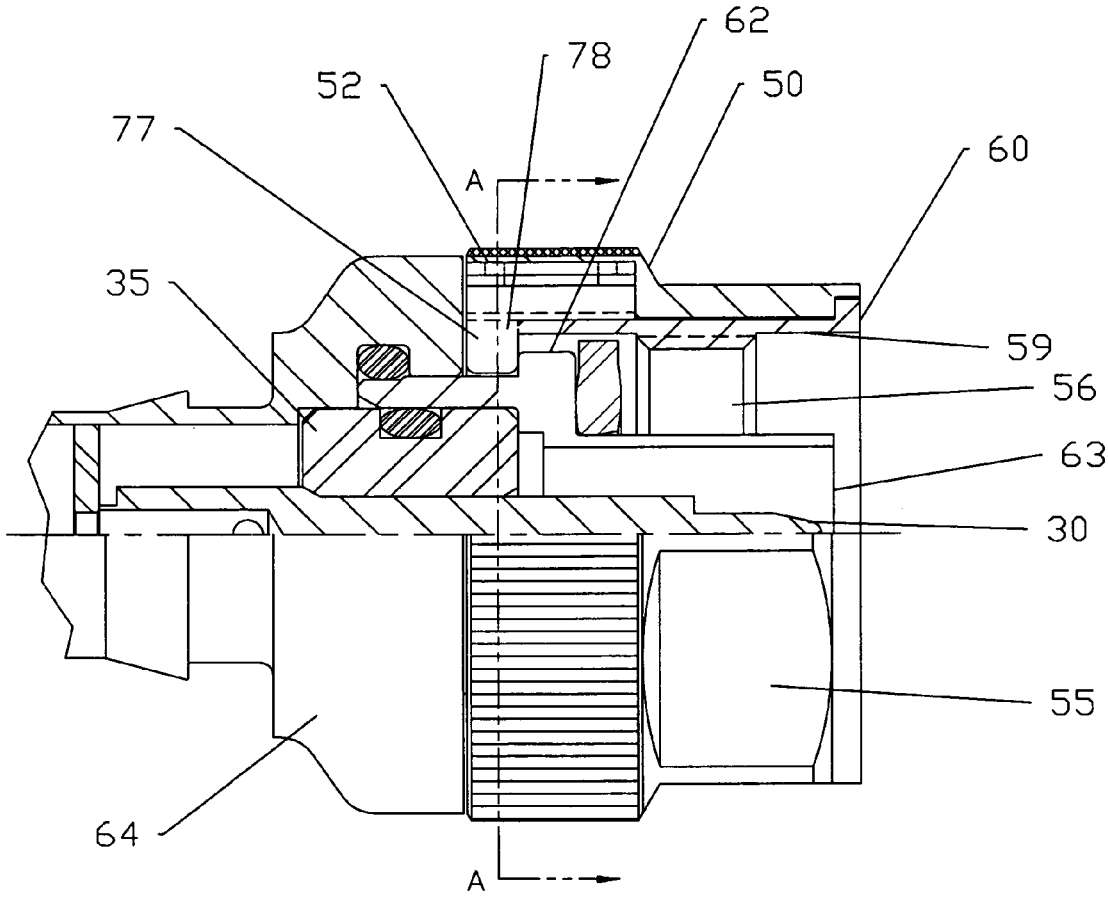
FIG. 6 is a partial cut-away side view of a coaxial connector according to another embodiment of the invention.
Figure 7:
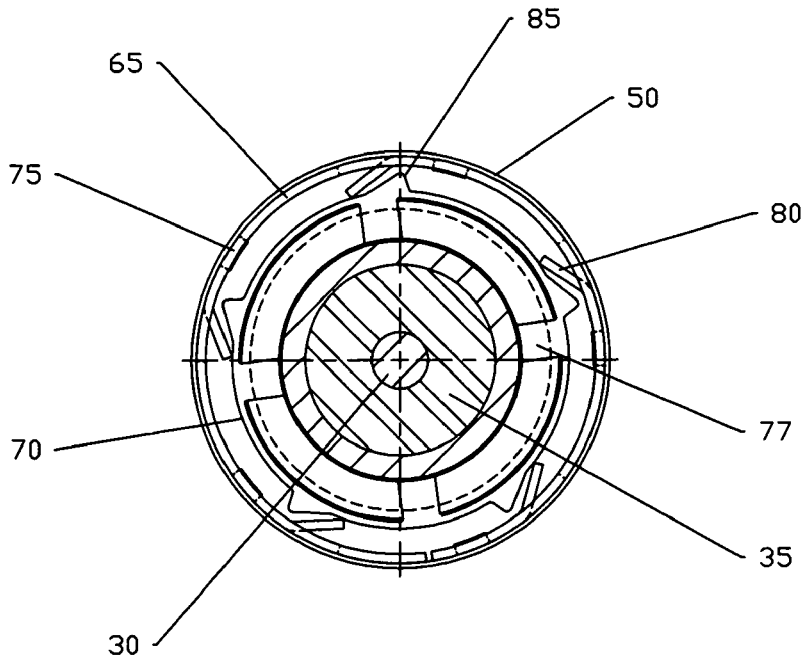
FIG. 7 is an end section view, along line A—A, of FIG. 6.
Figure 8:
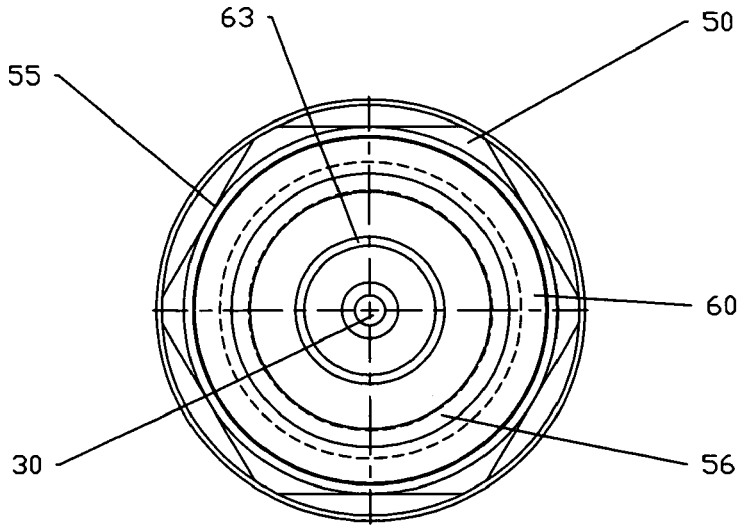
FIG. 8 is an end view of FIG. 6.

One or more over-tightening protection assembly(s) 24 of the connector 1 prevents damage to the connector body 50, rear clamp nut 10 (if present), threads, seals and or the relatively soft metal(s) of the cable(s). A separate over-tightening protection assembly 24 may be applied to operate with respect to the threads 25 and the connector threads 56, each with a separate desired torque rating. The over-tightening protection assembly 24 is explained with the aid of a simplified version of connector 1, as shown in FIGS. 6–8. The connector body 50 has an aperture dimensioned to accept an inner coupling sleeve 60. The inner coupling sleeve 60 has connector threads 56 located on an inner diameter 59 for coupling with other connectors and or equipment. The inner coupling sleeve 60 is retained in a rotatable configuration by an inward protruding coupling sleeve flange that overlaps a corresponding outer protruding interface flange 62 of an interface 63 that is press fit into the cable end 64 of the connector 1.

Figure 9:
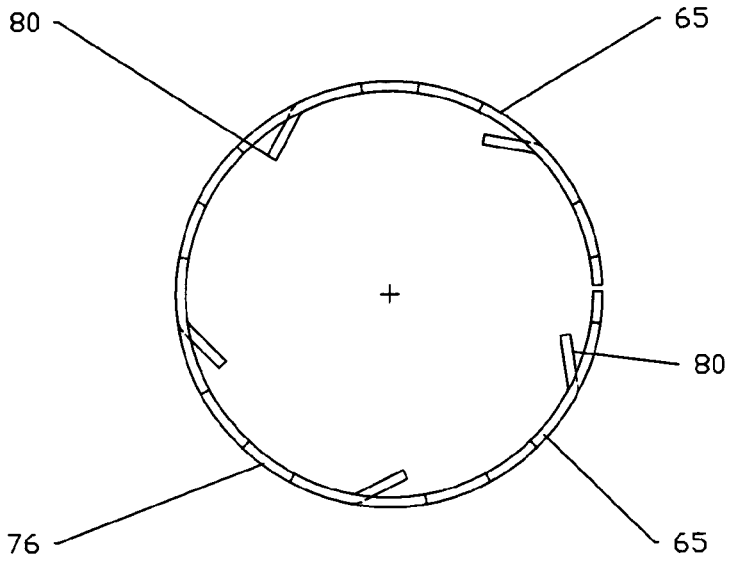
FIG. 9 is an end view of a finger ring according to the embodiment of the invention shown in FIGS. 6–8.
Figure 10:
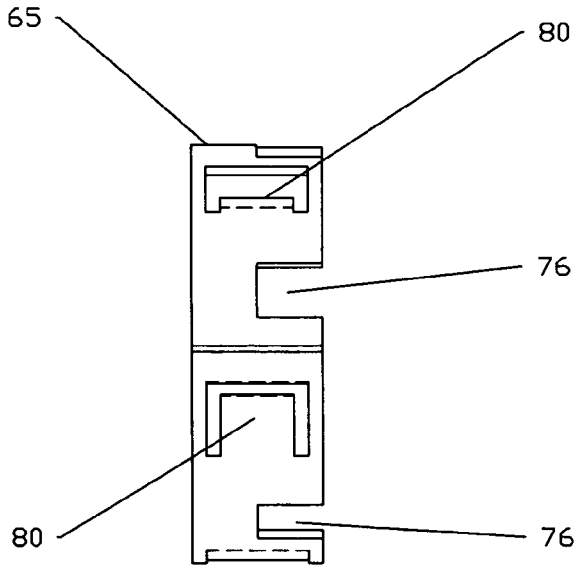
FIG. 10 is a side section view, along line A—A, of the finger ring shown in FIG. 9.
Figure 11:
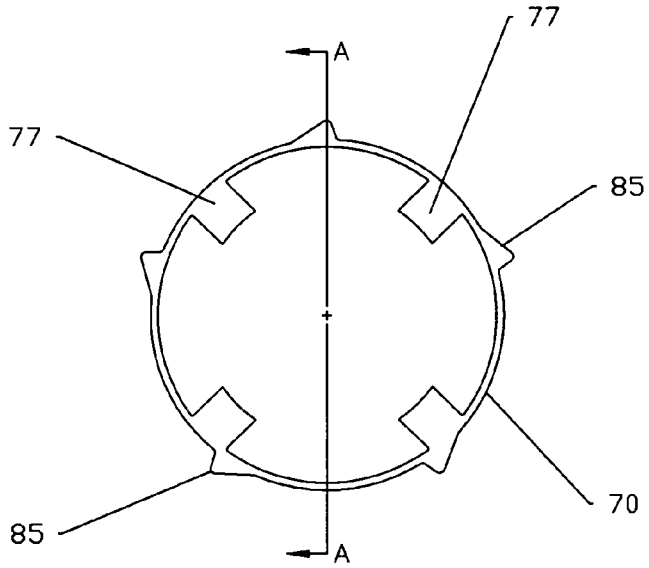
FIG. 11 is an end view of a ramp ring according to the embodiment of the invention shown in FIGS. 6–8.
Figure 12:
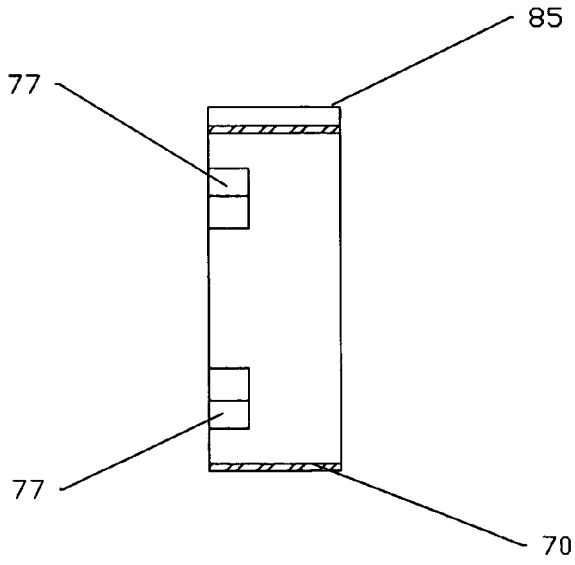
FIG. 12 is a side view of the ramp ring shown in FIG. 11.

Rotation of the connector body 50 is coupled, within a selected torque range, to the inner coupling sleeve 60 by a first ring and a second ring having complementary protrusions. To describe the first and second rings interaction in detail, a specific embodiment wherein the first ring is a finger ring 65, as shown for example in FIGS. 9 and 10, which mates with the second ring which is a ramp ring 70, as shown for example in FIGS. 10 and 11, will hereinafter be described.

The finger ring 65 and the ramp ring 70 may be located coaxially within a groove 52 formed in the connector body 50. The finger ring 65 may be keyed to the connector body 50 by a plurality of first ring tab(s) 75 distributed around the inner diameter of the groove 52 which interlock with corresponding finger ring slot(s) 76 in the finger ring 65. Similarly, the ramp ring 70 may be keyed to the inner coupling sleeve 60 by a plurality of inward projecting second ring tabs 77 that couple with inner coupling sleeve slot(s) 78 formed in, for example, a cable end of the inner coupling sleeve 60. Finger(s) 80 projecting inward from the finger ring 65 engage the ramp(s) 85 extending outwards from the ramp ring 70.

Rotation of the connector body 50 is transmitted to the inner coupling sleeve 60 for threading of the connector threads 56 until a predetermined torque value is reached whereupon the finger(s) 80 of the finger ring 65 and or the ramp(s) 85 of the ramp ring 70 momentarily deforms and slips past the ramp ring 70 or vice versa, preventing application of out of range torque levels to the inner coupling sleeve 60 and thereby to the connector threads 56, gaskets and or the relatively soft metal(s) of the cable(s). During reverse rotation, the finger(s) 80 impact a step side of the ramp(s) 85 having an increased angle ensuring that increased torque levels sufficient to enable unthreading of the connector 1 may be applied.

The torque value at which the finger ring 65 slips past the ramp ring 70 may be adjusted by selecting materials with desired bending/deformation characteristics; adjusting the angles of the mating surfaces of the finger(s) 80 and or ramp(s) 85; and or modifying the thickness of the selected material(s). For example, the finger ring 65 may be formed by a process comprising metal stamping, bending and ring rolling and the ramp ring 70 may be injection molded of a plastic such as nylon. Similarly, the positions of the finger and ramp ring pairs may be switched and or either or both of the first and second rings replaced with other forms of complementary protrusions and or interlocking structures of which at least one of a complementary pair will deform and release the connector body 50 to inner coupling sleeve 60 interlock when the applied rotation torque reaches a desired threshold level. For example, interlocking protrusions, bumps, arches and or leaf springs may be used with an equivalent effect according to the invention.

One skilled in the art will appreciate that the cable end of the connector 1 may be adapted to mate with the dimensions and configuration of a specific coaxial cable 5, for example a coaxial cable with annular or helical corrugations in the inner and or outer conductors 27, 15. Further, the connector end of the connector 1 may be adapted to mate according to male and or female embodiments of a proprietary interface or one of the standard connector types, for example BNC, Type-N or DIN.

The present invention provides coaxial connectors with ease of installation features and reduces specialized installation tool requirements. The sheath stripping cutting edge slot eliminates the need for a dedicated sheath stripping tool and strips the sheath to the correct outer conductor exposure during connector assembly without requiring a separate stripping step. Interleaved threads allow the connector to be installed with a significantly reduced threading requirement. Also, protection from damaging excess torque application during connector installation and elimination of the need for torque wrenches is built into the connector.

Table of Parts

| | |
|---|---|
| 1 | connector |
| 5 | coaxial cable |
| 10 | rear clamp nut |
| 15 | outer conuctor |
| 20 | sheath |
| 24 | over tightening protection assembly |
| 25 | threads |
| 26 | inner collar |
| 27 | inner conductor |
| 28 | cable end |
| 29 | connector end |
| 30 | inner contact |
| 31 | circular coil spring |
| 32 | rear clamp nut bore |
| 33 | thrust collar |
| 35 | insulator |
| 40 | slot |
| 45 | cutting edge |
| 47 | step |
| 50 | connector body |
| 52 | groove |
| 55 | flats |
| 56 | connector threads |

-continued

| Table of Parts | |
|---|---|
| 59 | inner diameter |
| 60 | inner coupling sleeve |
| 62 | interface flange |
| 63 | interface |
| 64 | cable end |
| 65 | finger ringe |
| 70 | ramp ring |
| 75 | first ring tab |
| 76 | finger ring slot |
| 77 | second ring tab |
| 78 | inner coupling sleeve slot |
| 80 | finger |
| 85 | ramp |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

The invention claimed is:

1. A coaxial connector for use with a coaxial cable having an inner conductor, an outer conductor and a sheath, comprising:

a rear clamp nut having a bore with a first inner diameter at a cable end and a smaller second inner diameter at a connector end; the first inner diameter dimensioned to accept the cable with the sheath and the second inner diameter dimensioned to accept the cable without the sheath;

a helical step between the first inner diameter and the second inner diameter extends around the bore between the cable end and the connector end of a slot with a cutting edge; the cutting edge at the second inner diameter operating to cut and separate the sheath from the outer conductor as the cable is inserted into the bore and rotated; and a connector body adapted to connect to the rear clamp nut at the connector end.

2. The connector of claim 1, wherein the connector body and the rear clamp nut are connected via threads.

3. The connector of claim 2, wherein the threads are a plurality of interleaved concentric threads.

4. The connector of claim 3, wherein there are one of two, three and four interleaved concentric threads.

5. The connector of claim 1, further including a first ring and a second ring positioned coaxially within a groove formed in an internal bore of the connector body; and an inner coupling sleeve rotatably positioned within the internal bore;

the first ring and the second ring each having a plurality of complementary protrusions;

the first ring coupled to the connector body and the second ring coupled to the inner coupling sleeve;

the complementary protrusions of the first ring and the second ring interact whereby the connector body is coupled to the inner coupling sleeve during rotation of the connector body via application of a torque below a threshold level;

at least one of the complementary protrusions deforming upon application of the torque at or above the threshold level to decouple the connector body from the inner coupling sleeve.

6. The connector of claim 5, wherein the coupling between the first ring and the connector body is via an internally projecting first tab in the groove which keys with a corresponding first ring slot in the first ring.

7. The connector of claim 5, wherein the coupling between the second ring and the inner coupling sleeve is via an inward projecting second ring tab which keys with a corresponding inner coupling sleeve slot in the inner coupling sleeve.

8. The connector of claim 5, wherein the plurality of complementary protrusions on the first ring is a plurality of fingers projecting inwards.

9. The connector of claim 5, wherein the plurality of complementary protrusions on the second ring is a plurality of ramps projecting outwards.

10. A coaxial connector, comprising:

a first ring and a second ring positioned coaxially within a groove formed in an internal bore of a connector body; and an inner coupling sleeve rotatably positioned within the internal bore;

the first ring and the second ring each having a plurality of complementary protrusions;

the first ring coupled to the connector body and the second ring coupled to the inner coupling sleeve;

the complementary protrusions of the first ring and the second ring interact whereby the connector body is coupled to the inner coupling sleeve during rotation of the connector body via application of a torque below a threshold level;

at least one of the complementary protrusions deforming upon application of the torque at or above the threshold level to decouple the connector body from the inner coupling sleeve.

11. The connector of claim 10, wherein the coupling between the first ring and the connector body is via an internally projecting first tab in the groove which keys with a corresponding first ring slot in the first ring.

12. The connector of claim 10, wherein the coupling between the second ring and the inner coupling sleeve is via an inward projecting second ring tab which keys with a corresponding inner coupling sleeve slot in the inner coupling sleeve.

13. The connector of claim 10, wherein the plurality of complementary protrusions on the first ring is a plurality of fingers projecting inwards.

14. The connector of claim 10, wherein the plurality of complementary protrusions on the second ring is a plurality of ramps projecting outwards.

15. The connector of claim 10, further including a rear clamp nut having a rear clamp nut bore with a first inner diameter at a cable end and a smaller second inner diameter at a connector end; the first inner diameter dimensioned to fit onto a coaxial cable with a sheath and the second inner diameter dimensioned to fit onto the cable without the sheath;

a helical step between the first inner diameter and the second inner diameter extends around the bore between the cable end and the connector end of a slot with a cutting edge; the cutting edge at the second inner diameter operating to cut and separate the sheath from the outer conductor as the cable is inserted into the bore and rotated; and the connector body adapted to connect to the rear clamp nut at the connector end.

16. The connector of claim 15, wherein the connector body and the rear clamp nut are connected via threads.

17. The connector of claim 16, wherein the threads are a plurality of interleaved concentric threads.

18. The connector of claim 17, wherein there are one of two, three and four interleaved concentric threads.

19. A coaxial connector, comprising:

a connector body connected to a rear clamp nut;

the connector body and the rear clamp nut connected via a plurality of interleaved concentric threads;

the rear clamp nut has a rear clamp nut bore with a first inner diameter at a cable end and a smaller second inner diameter at a connector end; the first inner diameter dimensioned to fit onto a coaxial cable with the sheath and the second inner diameter dimensioned to fit onto the coaxial cable without the sheath;

a helical step between the first inner diameter and the second inner diameter extends around the bore between the cable end and the connector end of a slot with a cutting edge; the cutting edge at the second inner diameter operating to cut and separate the sheath from the outer conductor as the cable is inserted into the rear clamp nut bore and rotated.

20. A coaxial connector, comprising:

a connector body connected to a rear clamp nut;

the connector body and the rear clamp nut are connected via a plurality of interleaved concentric threads;

a first ring and a second ring positioned coaxially within a groove formed in an internal bore of the connector body; and an inner coupling sleeve rotatably positioned within the internal bore;

the first ring and the second ring each having a plurality of complementary protrusions;

the first ring coupled to the connector body and the second ring coupled to the inner coupling sleeve;

the complementary protrusions of the first ring and the second ring interact whereby the connector body is coupled to the inner coupling sleeve during rotation of the connector body via application of a torque below a threshold level;

at least one of the complementary protrusions deforming upon application of the torque at or above the threshold level to decouple the connector body from the inner coupling sleeve.

21. The connector of claim 20, wherein the coupling between the first ring and the connector body is via an internally projecting first tab in the groove which keys with a corresponding first ring slot in the first ring.

22. The connector of claim 20, wherein the coupling between the second ring and the inner coupling sleeve is via an inward projecting second ring tab which keys with a corresponding inner coupling sleeve slot in the inner coupling sleeve.

23. The connector of claim 20, wherein the plurality of complementary protrusions on the first ring is a plurality of fingers projecting inwards.

24. The connector of claim 20, wherein the plurality of complementary protrusions on the second ring is a plurality of ramps projecting outwards.

* * * * *